US008714819B2

(12) United States Patent
Hui et al.

(10) Patent No.: US 8,714,819 B2
(45) Date of Patent: May 6, 2014

(54) RECLOSABLE FASTENER

(75) Inventors: Jonathan Hui, Hong Kong (CN); Mark Branson, New Palestine, IN (US)

(73) Assignee: Global Packaging Solutions Limited, Hong Kong (HK)

( * ) Notice: Subject to any disclaimer, the term of this patent is extended or adjusted under 35 U.S.C. 154(b) by 1738 days.

(21) Appl. No.: 11/627,148

(22) Filed: Jan. 25, 2007

(65) Prior Publication Data

US 2007/0116387 A1 May 24, 2007

Related U.S. Application Data

(63) Continuation-in-part of application No. 11/263,607, filed on Oct. 31, 2005, now Pat. No. 8,096,022, and a continuation-in-part of application No. 11/424,016, filed on Jun. 14, 2006, now Pat. No. 8,256,959.

(51) Int. Cl.
*B65D 33/16* (2006.01)
*B65D 33/25* (2006.01)
*B65D 77/18* (2006.01)

(52) U.S. Cl.
USPC ..... 383/64; 24/436; 24/30.5 R

(58) Field of Classification Search
USPC ..... 383/64, 65; 24/399, 400, 436, 30.5 R, 24/585.12
See application file for complete search history.

(56) References Cited

U.S. PATENT DOCUMENTS 2,581,604 A 1/1952 Roehrl
3,054,434 A 9/1962 Ausnit
(Continued)

FOREIGN PATENT DOCUMENTS

CN 1253480 5/2000
CN 1703154 11/2005
(Continued)

OTHER PUBLICATIONS

International Search Report and Written Opinion corresponding to International Application Serial No. PCT/US07/66410, 13 pages, dated Sep. 25, 2008.

(Continued)

*Primary Examiner* — J. Gregory Pickett
*Assistant Examiner* — Latrice Byrd
(74) *Attorney, Agent, or Firm* — Vedder Price P.C.

(57) ABSTRACT

This invention is directed to an improved reclosable bag having first and second walls and an open top. The open top has first and second flexible fastener strips attached thereto. One of the strips has a profile portion forming a groove; the other strip has a profile portion forming a rib with a portion of the rib received and retained in the groove when the bag top is closed. Each of the fastener strips has a base connected to the respective walls. The bag has a slider mounted on the fastener strips which is movable longitudinally along the fastener strip to progressively separate the rib from the groove to open the bag, and is movable in the opposite direction to progressively return rib to a retained condition in the groove and create a leak-proof seal. A cradle is formed near one end of the fastener strip which is sized, constructed and arranged to receive and retain the base of the slider when the fastener strip is sealed to prevent leakage from that end of the fastener strip. The cradle preferably has a length greater than the length of the slider so it is retained therein and is curved in its interior configuration. In a preferred embodiment, the cradle has a tab which is also curved and extends angularly from the cradle for abutment against and retention of the slider within the cradle.

68 Claims, 12 Drawing Sheets

(56) References Cited

U.S. PATENT DOCUMENTS

| | | | | |
|---|---|---|---|---|
| 3,122,807 | A | 3/1964 | Ausnit | |
| 3,173,184 | A | 3/1965 | Ausnit | |
| 3,220,076 | A | 11/1965 | Ausnit | |
| 3,230,593 | A | 1/1966 | Herz | |
| 3,259,951 | A | 7/1966 | Zimmerman | |
| 3,338,284 | A | 8/1967 | Ausnit | |
| 3,713,923 | A | 1/1973 | Laguerre | |
| 3,852,386 | A | 12/1974 | Behr | |
| 4,262,395 | A | 4/1981 | Kosky | |
| 4,620,320 | A | 10/1986 | Sullivan | |
| 4,663,915 | A | 5/1987 | Van Erden et al. | |
| 4,710,968 | A | 12/1987 | Borchardt et al. | |
| 4,778,282 | A | 10/1988 | Borchardt et al. | |
| 4,819,309 | A | 4/1989 | Behymer | |
| 4,846,585 | A | 7/1989 | Boeckmann et al. | |
| 5,007,143 | A | 4/1991 | Herrington | |
| 5,020,194 | A | 6/1991 | Herrington | |
| 5,048,692 | A | 9/1991 | Handler et al. | |
| 5,067,208 | A | 11/1991 | Herrington et al. | |
| 5,131,121 | A | 7/1992 | Herrington, Jr. et al. | |
| 5,189,764 | A * | 3/1993 | Herrington et al. | 24/384 |
| 5,272,794 | A | 12/1993 | Hamatani et al. | |
| 5,301,395 | A * | 4/1994 | Richardson et al. | 24/400 |
| 5,351,369 | A | 10/1994 | Swain | |
| 5,442,837 | A | 8/1995 | Morgan | |
| 5,442,838 | A | 8/1995 | Richardson et al. | |
| 5,482,375 | A | 1/1996 | Richardson | |
| 5,647,100 | A | 7/1997 | Porchia et al. | |
| 5,664,296 | A | 9/1997 | May | |
| 5,664,299 | A | 9/1997 | Porchia | |
| 5,689,866 | A | 11/1997 | Kasai et al. | |
| 5,836,056 | A * | 11/1998 | Porchia et al. | 24/400 |
| 5,871,281 | A | 2/1999 | Stolmeier et al. | |
| 5,924,173 | A | 7/1999 | Dobreski et al. | |
| 5,950,285 | A | 9/1999 | Porchia et al. | |
| 5,956,815 | A | 9/1999 | O'Connor et al. | |
| 5,956,924 | A | 9/1999 | Thieman | |
| 6,000,197 | A | 12/1999 | Ausnit | |
| 6,088,087 | A | 7/2000 | Graves et al. | |
| 6,088,887 | A * | 7/2000 | Bois | 24/399 |
| 6,178,602 | B1 | 1/2001 | Burke et al. | |
| 6,178,722 | B1 | 1/2001 | McMahon | |
| 6,182,337 | B1 | 2/2001 | Machacek | |
| 6,217,215 | B1 | 4/2001 | Tomic | |
| 6,287,001 | B1 | 9/2001 | Buchman et al. | |
| 6,292,986 | B1 | 9/2001 | Provan | |
| 6,305,844 | B1 | 10/2001 | Bois | |
| 6,385,818 | B1 | 5/2002 | Savicki | |
| 6,390,676 | B1 | 5/2002 | Colombo et al. | |
| 6,419,391 | B2 * | 7/2002 | Thomas | 383/5 |
| 6,461,042 | B1 | 10/2002 | Tomic et al. | |
| 6,470,551 | B1 | 10/2002 | Provan et al. | |
| 6,477,820 | B1 | 11/2002 | Dutra et al. | |
| 6,524,002 | B2 * | 2/2003 | Tomic | 383/64 |
| 6,562,165 | B1 | 5/2003 | Bauman et al. | |
| 6,571,430 | B1 | 6/2003 | Savicki et al. | |
| 6,575,628 | B1 * | 6/2003 | Borchardt et al. | 383/64 |
| 6,576,278 | B1 | 6/2003 | Sprehe | |
| 6,581,249 | B1 | 6/2003 | Savicki et al. | |
| 6,581,253 | B2 | 6/2003 | ErkenBrack | |
| 6,582,122 | B2 | 6/2003 | Shimizu | |
| 6,594,872 | B2 | 7/2003 | Cisek | |
| 6,595,689 | B1 | 7/2003 | Burchardt | |
| 6,609,353 | B1 | 8/2003 | McMahon | |
| 6,609,827 | B2 | 8/2003 | Bois | |
| 6,622,353 | B2 | 9/2003 | Provan | |
| 6,632,021 | B2 | 10/2003 | Bois | |
| 6,691,383 | B2 | 2/2004 | Linton | |
| 6,692,147 | B2 | 2/2004 | Nelson | |
| 6,694,704 | B1 | 2/2004 | Ausnit | |
| 6,698,925 | B2 | 3/2004 | Bentsen | |
| 6,721,999 | B2 | 4/2004 | Meager | |
| 6,733,178 | B2 | 5/2004 | Bois | |
| 6,739,755 | B2 | 5/2004 | Schreiter | |
| 6,755,569 | B2 | 6/2004 | Bois | |
| 6,761,481 | B1 | 7/2004 | Bois | |
| 6,789,947 | B1 | 9/2004 | Kasai | |
| 6,810,641 | B2 | 11/2004 | Ausnit | |
| 6,817,763 | B2 | 11/2004 | Tomic | |
| 6,826,808 | B2 | 12/2004 | Kutschka | |
| 6,846,107 | B2 | 1/2005 | Sweeney et al. | |
| 6,854,886 | B2 | 2/2005 | Piechocki et al. | |
| 6,854,887 | B2 | 2/2005 | Anderson | |
| 6,860,952 | B2 | 3/2005 | Pawloski | |
| 6,862,866 | B2 | 3/2005 | Jacobsen et al. | |
| 6,901,637 | B2 | 6/2005 | Machacek | |
| 6,902,321 | B2 | 6/2005 | Bois | |
| 6,915,546 | B2 | 7/2005 | Kasai | |
| 6,948,848 | B2 | 9/2005 | Ausnit | |
| 6,954,969 | B1 | 10/2005 | Sprehe | |
| 6,964,519 | B2 | 11/2005 | ErkenBrack | |
| 7,008,106 | B2 | 3/2006 | Cappel | |
| 7,017,240 | B2 | 3/2006 | Savicki | |
| 7,189,001 | B2 | 3/2007 | Gerrits | |
| 7,313,846 | B2 | 1/2008 | Stolmeier | |
| 7,318,257 | B2 | 1/2008 | Offa-Jones | |
| 7,337,507 | B2 | 3/2008 | Wright et al. | |
| 7,416,338 | B2 * | 8/2008 | Ausnit | 383/64 |
| 7,540,662 | B2 * | 6/2009 | Thieman | 383/64 |
| 2002/0034342 | A1 | 3/2002 | Bois | |
| 2002/0064321 | A1 * | 5/2002 | Schreiter | 383/64 |
| 2002/0114540 | A1 | 8/2002 | Shimizu | |
| 2002/0152723 | A1 | 10/2002 | Ausnit | |
| 2002/0154837 | A1 | 10/2002 | Ausnit | |
| 2003/0077009 | A1 | 4/2003 | Schreiter | |
| 2003/0101552 | A1 | 6/2003 | Plourde | |
| 2003/0177619 | A1 | 9/2003 | Cisek | |
| 2003/0217444 | A1 | 11/2003 | Blythe | |
| 2003/0223654 | A1 | 12/2003 | Gerrits | |
| 2004/0000501 | A1 | 1/2004 | Shah et al. | |
| 2004/0001650 | A1 | 1/2004 | Piechocki | |
| 2004/0010893 | A1 | 1/2004 | Kasai | |
| 2004/0022460 | A1 | 2/2004 | Plourde | |
| 2004/0037477 | A1 * | 2/2004 | Buchman | 383/64 |
| 2004/0045134 | A1 | 3/2004 | Savicki | |
| 2004/0045138 | A1 | 3/2004 | Kasai | |
| 2004/0066984 | A1 | 4/2004 | Yi Li | |
| 2004/0066985 | A1 * | 4/2004 | Patel et al. | 383/64 |
| 2004/0091179 | A1 | 5/2004 | Anderson | |
| 2004/0136617 | A1 | 7/2004 | Gerrits | |
| 2004/0136618 | A1 * | 7/2004 | Ausnit et al. | 383/64 |
| 2004/0161167 | A1 | 8/2004 | Ausnit | |
| 2004/0161178 | A1 | 8/2004 | Olechowski | |
| 2004/0165794 | A1 | 8/2004 | Plourde | |
| 2004/0204303 | A1 | 10/2004 | Wright et al. | |
| 2004/0252915 | A1 | 12/2004 | Nelson | |
| 2004/0252916 | A1 * | 12/2004 | Smith et al. | 383/64 |
| 2005/0008266 | A1 | 1/2005 | Crunkleton et al. | |
| 2005/0008267 | A1 | 1/2005 | Linton et al. | |
| 2005/0025396 | A1 | 2/2005 | ErkenBrack | |
| 2005/0041892 | A1 * | 2/2005 | Stolmeier | 383/64 |
| 2005/0063620 | A1 | 3/2005 | Anderson | |
| 2005/0129338 | A1 | 6/2005 | Sprehe | |
| 2005/0137073 | A1 | 6/2005 | Weaver | |
| 2005/0141786 | A1 | 6/2005 | Piechocki | |
| 2005/0178691 | A1 | 8/2005 | Frenkil | |
| 2005/0207679 | A1 | 9/2005 | Armstrong | |
| 2005/0220371 | A1 | 10/2005 | Machacek | |
| 2006/0171607 | A1 | 8/2006 | Schneider | |
| 2006/0171610 | A1 * | 8/2006 | Buchman et al. | 383/64 |
| 2006/0269170 | A1 | 11/2006 | Chatuvedi | |
| 2007/0094850 | A1 | 5/2007 | Hui | |
| 2007/0116387 | A1 | 5/2007 | Hui et al. | |
| 2007/0292052 | A1 | 12/2007 | Hui et al. | |

FOREIGN PATENT DOCUMENTS

| | | |
|---|---|---|
| EP | 1289845 | 9/2005 |
| EP | 1693308 | 8/2006 |
| FR | 2770493 | 7/1999 |
| JP | 2001-315806 | 11/2001 |
| JP | 2004-083068 | 3/2004 |
| JP | 2004083068 | 3/2004 |
| JP | 2004-196321 | 7/2004 |

(56) References Cited

FOREIGN PATENT DOCUMENTS

| | | | |
|---|---|---|---|
| JP | 2004196321 | | 7/2004 |
| JP | 2005289452 | | 10/2005 |
| JP | 2006-076619 | | 3/2006 |
| WO | 2004103827 | | 12/2004 |
| WO | WO2004103827 | A2 | 12/2004 |
| WO | WO2007/146483 | | 12/2007 |
| WO | WO2008/092123 | | 7/2008 |

OTHER PUBLICATIONS

International Preliminary Examination Report corresponding to Application Serial No. PCT/US07/066410, 9 pages, dated Dec. 16, 2008.

European Search Report corresponding to European Application Serial No. EP08728343, 8 pages, dated Oct. 6, 2011.

European Search Report corresponding to European Application Serial No. EP07781715, 8 pages, dated Oct. 29, 2011.

International Preliminary Examination Report corresponding to Application Serial No. PCT/US08/052120, 9 pages, dated Jul. 28, 2009.

International Search Report and Written Opinion corresponding to International Application Serial No. PCT/US08/52120, 15 pages, dated Aug. 1, 2008.

Search Report for Application No. CN2011102791085 dated May 27, 2013.

* cited by examiner

| No. | Tool Type | Distance | Width | Height | Angle | Radius | Area |
|---|---|---|---|---|---|---|---|
| 1 | Length | | | 3.35 | | | |
| 2 | Length | | | 2.15 | | | |
| 4 | Length | | | 2.03 | | | |
| 6 | Width | | 9.78 | | | | |
| 5 | Radius | | | | | 0.07 | |
| | | | | | | | |

Created: 2007-1-20 ïÂÍç 03:19:19

Ultrasonic tooling improve after produce bags 5.6mm inside.
2.2mm outside
1.6mm Hook
2.4mm Hook L
5mm concave
4.6mm inside.

RECLOSABLE FASTENER

This application is a continuation-in-part of U.S. patent application Ser. No. 11/263,607 filed Oct. 31, 2005 and U.S. patent application Ser. No. 11/424,016 filed Jun. 14, 2006.

SUMMARY OF THE INVENTION

A reclosable bag having first and second walls is disclosed with an open top defined by first and second elongate flexible fastener strips attached to the first and second walls, respectively, adjacent the top of the walls. One of the fastener strips has a profile portion forming a groove, and the other fastener strip has a profile portion forming a rib, with a portion of the rib received and retained in the groove when the bag top is closed. Each of the fastener strips has a base connected to the respective wall and each of the strips has an upper edge adjacent the upper edge adjacent the upper edge of the other strip. The bag has a slider mounted on the fastener strips which is moveable in one direction longitudinally of the fastener strips to progressively separate the rib from the groove to open the bag and the slider is moveable in the opposite direction to progressively return the rib portion to a retained condition in the groove to close the bag. The improvement over the prior art is a cradle provided near one end of the fastener strip sized, constructed and arranged to receive and retain the base of the slider therein, while the fastener strip is engaged with the corresponding sealing portion of the complementary sealing member. As a result, the sealing members remain interlocked and closed to provide a leak-tight seal. In one embodiment, the cradle has a tab extending therefrom at an angle of approximately 45° for abutment against and retention of the slider in the cradle. In a preferred embodiment, the cradle is of a length greater than the length of the slider so as to allow variations in the size of the slider during manufacture while still retaining the slider within the cradle and, thus, sealing the fastener strip. The cradle preferably has a tab extending therefrom at an angle of approximately 45° for abutment against and retention of the slider in the cradle. In a preferred embodiment the cradle is substantially C-shaped in it's internal configuration so as to retain the slider therein. The tab, although preferably at 45° extending from the cradle, can also extend at an angle from 15°-30° so as to abut against the slider and retain the slider within the cradle. In one embodiment the tab can abut against the separator within the slider. The cradle is preferably curved on at least one end so as to retain the slider therein. It is preferably curved at both ends.

BACKGROUND OF THE INVENTION

The present invention relates generally to improvements in flexible fasteners of the type having releasably interlocking rib and groove elements with a slider to interlock or separate the rib and groove elements. The invention relates specifically to slide fasteners formed along one edge of the reclosable bag. The slide fasteners have a pair of fastener strips running along the top of the bag integrally formed in the bag wall. One of the fastener strips has an arrowhead-shaped profile extending perpendicularly from and transverse to the top of the bag. The other oppositely opposed fastener strip has a C-shaped profile sized, constructed and arranged for the arrowhead-shaped profile.

A problem in the manufacture of slide fasteners for profile strips is to secure the slider to the profile strip, to allow sealing of the fastener strip in an essentially leak-proof manner and to prevent removal of the slides from the bag.

Accordingly, it is an object of the present invention to manufacture slide fasteners in which the fasteners are easily opened, but are substantially leakproof when sealed.

It is an additional object of the invention to provide sliders or slide fasteners which are extremely difficult to remove from the bag, in order to provide a child safety feature.

It is a further object of the invention to provide slide fasteners in which the fasteners and the film for the bags can be co-extruded so as to simplify the manufacturing process and reduce costs.

It is a further object of the invention to provide fastener strips having a cradle for receiving and selectively retaining the slider therein so that the slider fasteners remain substantially leakproof at their ends when the slider has been moved to a fully closed position on the fastener strips.

The foregoing description of drawings merely explains and illustrates the invention and the invention is not limited thereto, except insofar as those who have the disclosure before them are able to make modifications and variations therein without departing from the invention.

DETAILED DESCRIPTION OF THE PREFERRED EMBODIMENT

Figure 1:
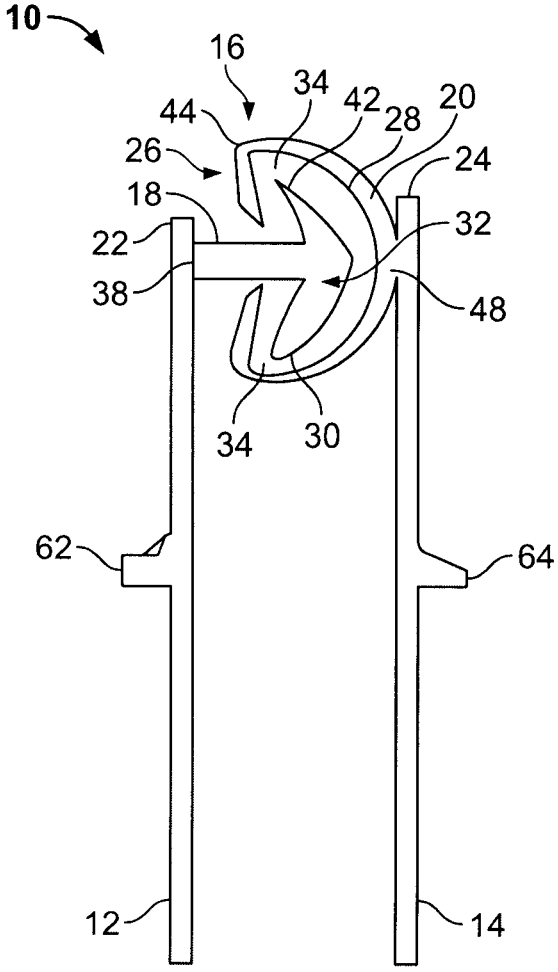
FIG. 1 of the drawings is a vertical section of the reclosable fastener profile of the present invention, partially broken away, showing male and female profiles, and guide ribs disposed on the outer walls of the reclosable bag.
Figure 2:
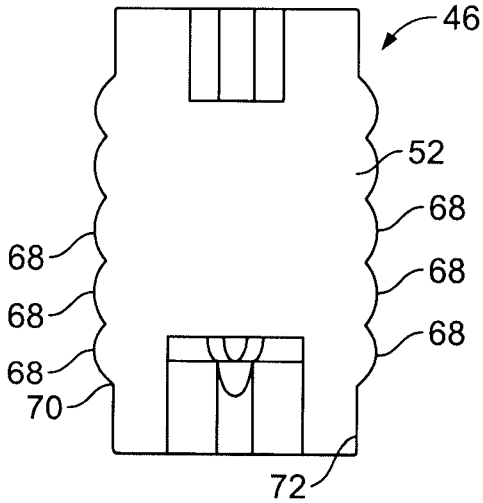
FIG. 2 of the drawings is a top view of the slider of the present invention.
Figure 3:
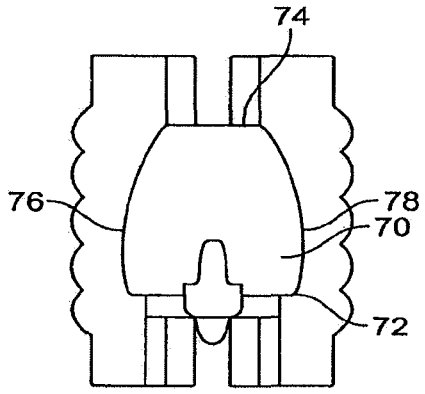
FIG. 3 of the drawings is a bottom view of the slider of the present invention.

As shown in FIG. 1 of the drawings, a reclosable bag 10 having first and second walls 12 and 14 and an open top 16 is defined by first and second elongate flexible strips 18 and 20 attached to the first and second walls 12 and 14, respectively, adjacent the top 22 and 24 of the walls. One of the fastener strips 20 has a profile portion 26 which forms a groove 28. The other fastener strip 18 has a profile portion 30 forming a rib 32 with a portion of the rib 34 received and retained within the groove 28 when the bag 36 is closed. Each of the strips 18 and 20 has a base 38 and 48 connected to the respective walls 22 and 24 and each of the strips 18 and 20 further has an upper edge 42 and 44 adjacent the upper edge of the other strip 18 and 20, respectively.

Figure 7:
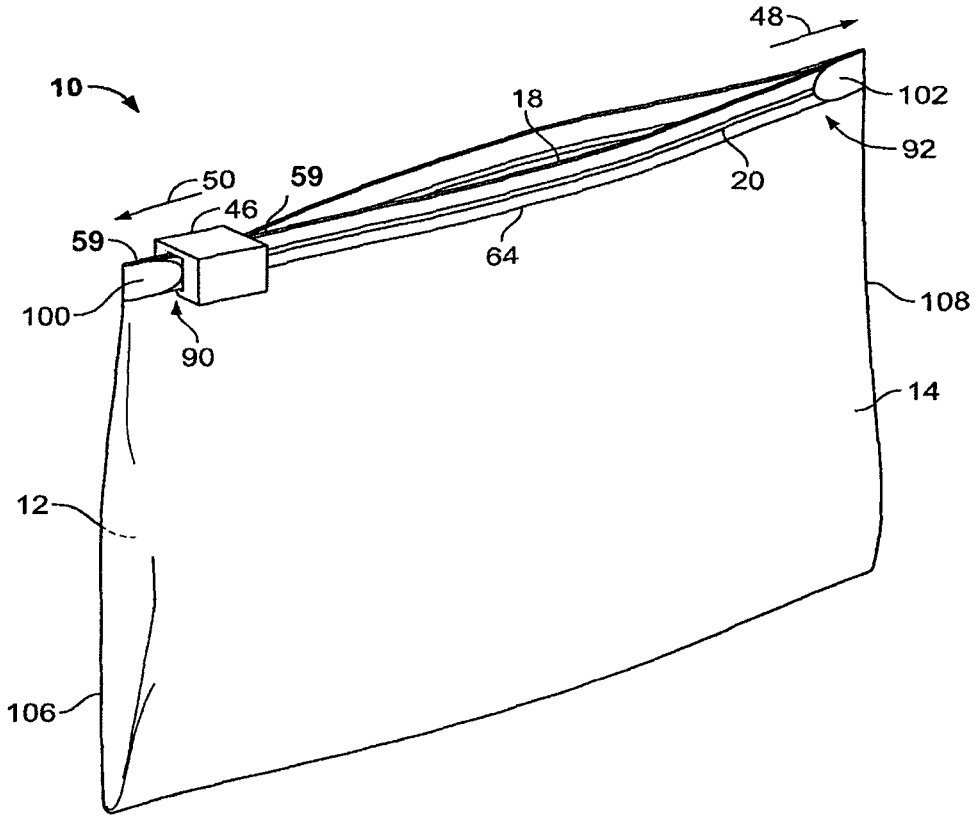
FIG. 7 of the drawings is a front perspective view of the reclosable container of FIG. 1.
Figure 8:
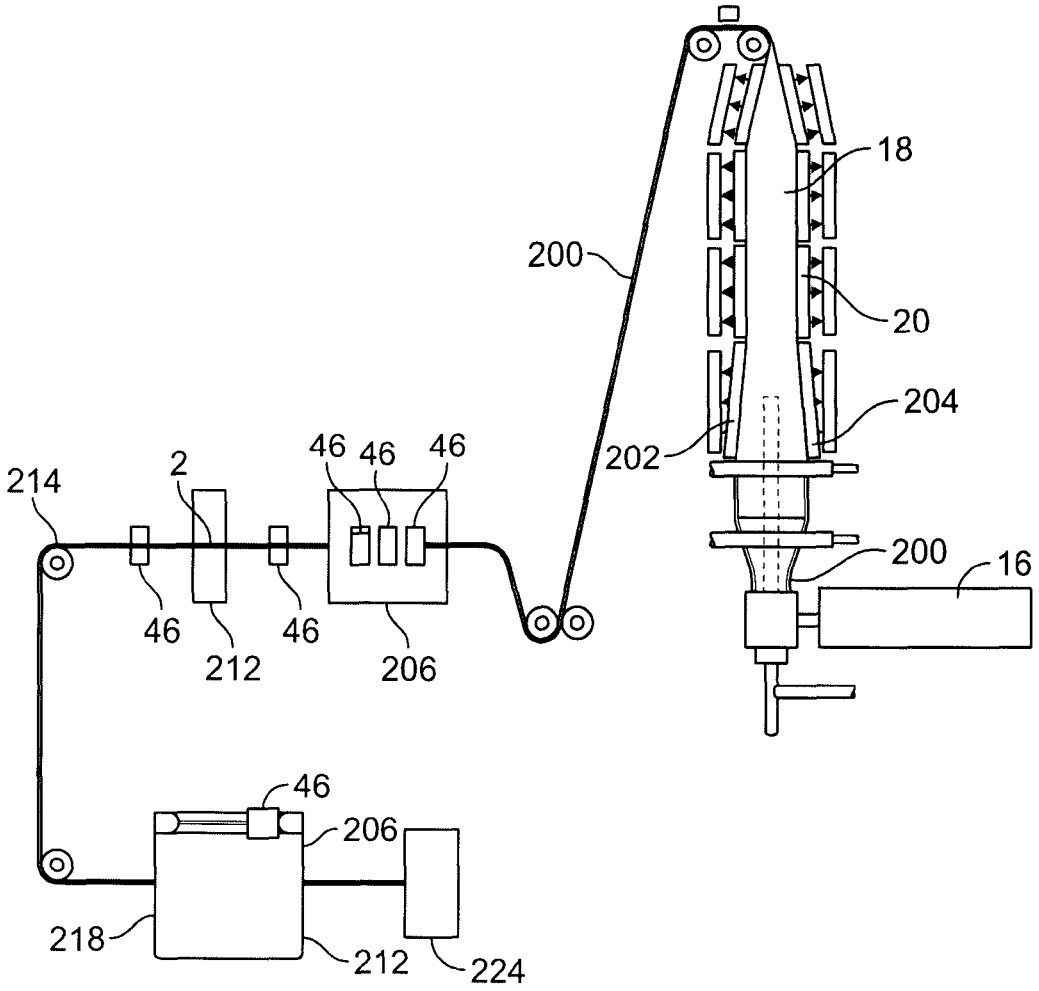
FIG. 8 of the drawings is a front view of the apparatus for extruding thermoplastic film having fastener profiles integrally formed therein.
Figure 9:
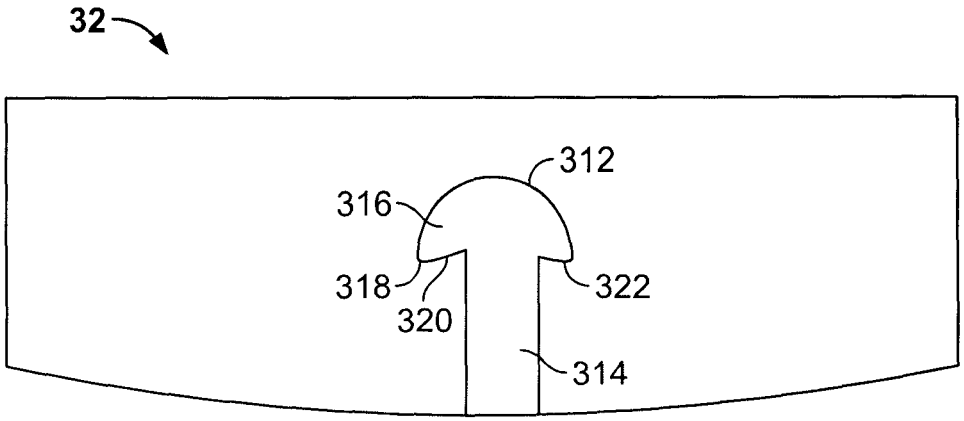
FIG. 9 of the drawings is a front perspective view of a portion of the die used for manufacturing a male profile in the fastener strips of FIG. 1.
Figure 10:
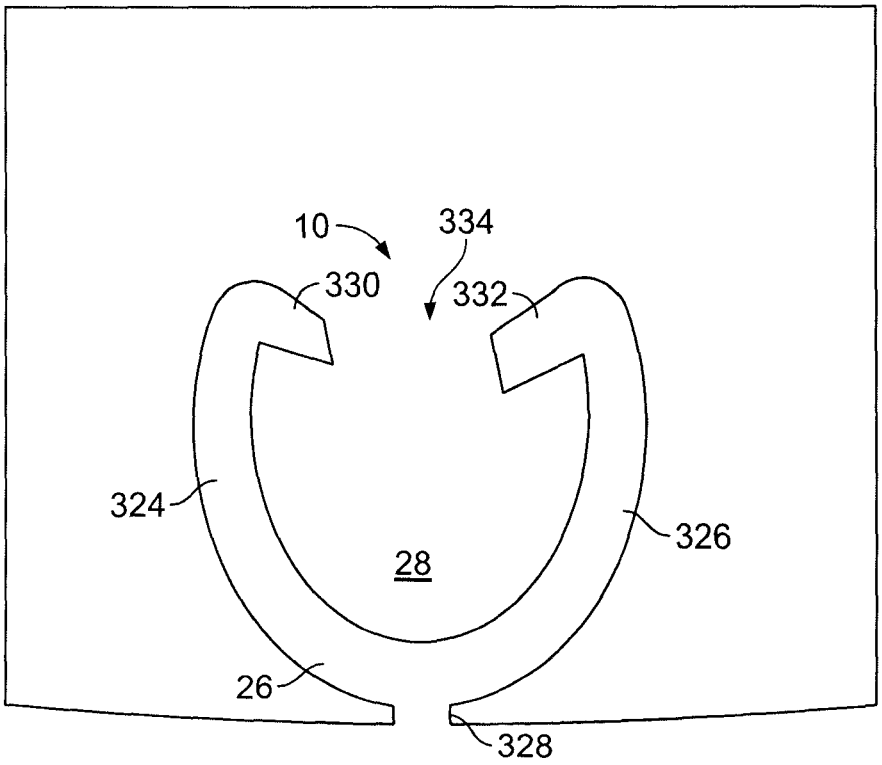
FIG. 10 of the drawings is a front perspective view of one portion of the die used manufacturing female profile in the fastener strips of FIG. 1.
Figure 11:
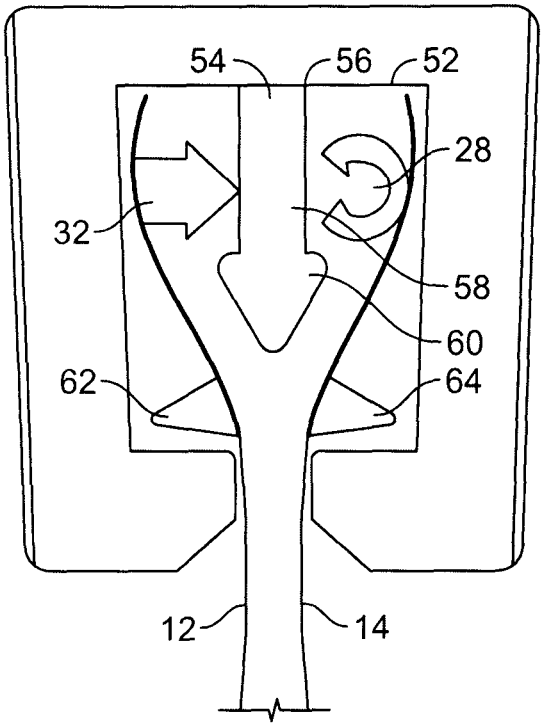
FIG. 11 of the drawings is a vertical section of the male and female profiles of FIG. 1 extending from the bag walls, with the slider disposed on the fastener and held in place by the bottom track extending laterally from the bag walls, as well as the separator extending between the male and female profiles.
Figure 12:
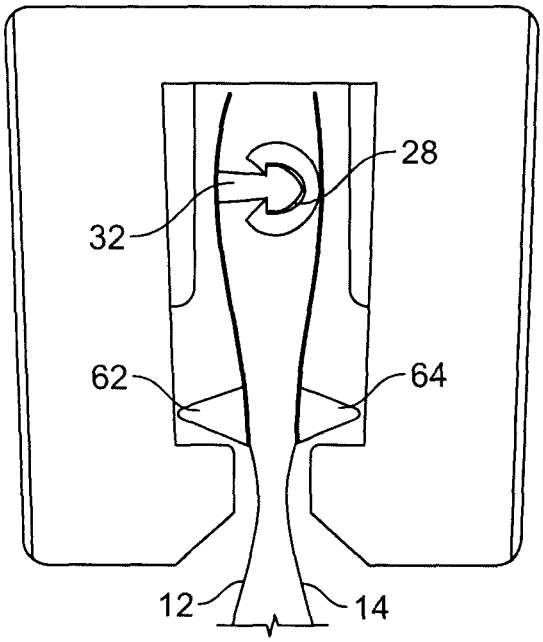
FIG. 12 of the drawings is a vertical section of the bag and fastener strip of FIG. 11 showing in particular the male and female profiles interlocked and the slider affixed to the fastener strip by the bottom tracks.

As shown in FIG. 7, bag 10 has a slider 46 mounted on the strips 18 and 20 and moveable in one direction 48 longitudinally of the strips 18 to 20 to progressively separate the rib 34 from the groove 28 to open the bag 10. Slider 46, being moveable in the opposite direction 50, progressively returns the rib 32 portion to retain condition in the groove 28 to close the bag.

As shown in FIGS. 1-6, the slider 46 further has a top 52. The slider 46 further has a separator 54 situated therein having a proximal portion 56 attached to the top 52 of the slider 46 and extending downwardly therefrom and having a distal portion 58 residing in a first space 60 between the top of the slider and the upper edges of the groove 28 when the rib portion 32 is retained in the groove 28 of the profile. The separator 54 has an arrow-shaped tip 60 constructed and arranged, i.e., positioned and sized to facilitate selective separation of the rib 32 from the groove 28.

In the preferred embodiment the separator has a length of 2.3 mm±0.3 mm. The separator 54 is preferably integrally formed from the slider 46 and is made of one homogeneous unit of plastic, preferably injection molded POM ocetel rock or that sold by RTP Company, Winona, Minn., or polypropylene with additive for lubrication.

In the preferred embodiment the slider is constructed of polyethylene, polycarbonate, polystyrene, acryl nitryl butyldirene styrene or other commonly formed injection molded plastic pieces.

As a further feature of the invention as shown in FIG. 1, the outside walls 12, 14 have a pair of flanges 62 and 64 or tracks extending outwardly therefrom and running parallel to the upper edges 22, 24 of the walls. The flanges 62 and 64 are sized for telescopic reception in slider 46, as will be further described herein.

Figure 4:
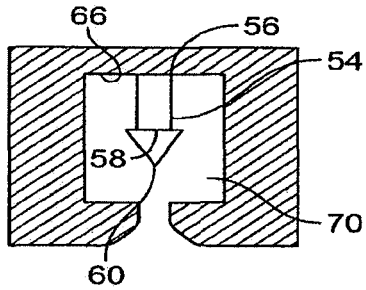
FIG. 4 of the drawings is a front cutaway view of the slider of FIGS. 2 and 3 showing a separator extending downwardly from the top surface thereof.

As seen in FIGS. 2-6, slider 46 has a top portion 52. Extending downwardly from top portion 52, as is seen in FIG. 4, is a separator 54 having a distal portion 58. The distal portion 58 of separator 54 has an arrowhead-shaped tip 60 mounted thereon. The arrowhead has an angle of 60°±10° which is to facilitate opening of groove 28 of profile portion 26 with rib 32 profile portion 30 as contained therein.

In the preferred embodiment, top portion 52 of slider 46 is approximately 1.2 mm in thickness. The distal portion 58 extends approximately 2.3 mm from the inside surface 66 of top 52. Slider 46 preferably has a height of approximately 8.6 mm, a thickness at its ends of 1.15 mm, a length of 14.8 mm, and the arrowhead-shaped tip 60 of a height of approximately 1 mm.

In the preferred embodiment, slider 46 has a series of gripping ribs 68 which are vertically disposed along its lateral edges 70 and 72, respectively. These gripping ribs 68 in the preferred embodiment have a radius of approximately 1.25 mm.

In the preferred embodiment, slider 46 has an interior chamber 70 having vertical walls at the front and rear ends 72 and 74, and having curved sidewalls 76 and 78 which have a radius of 9.9 mm.

Figure 5:
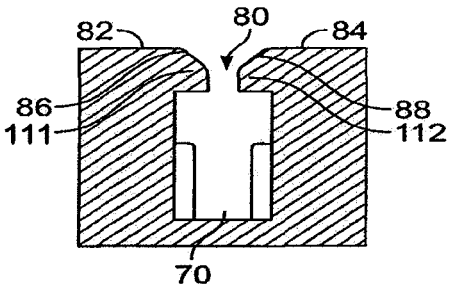
FIG. 5 of the drawings is a rear cutaway view of the slider of FIGS. 2-4.
Figure 6:
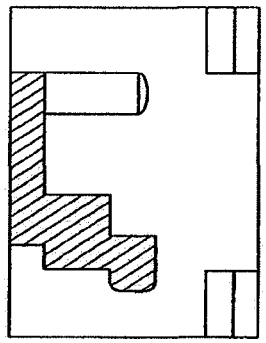
FIG. 6 of the drawings is a vertical section taken along the lines BB of FIG. 3 showing the internal configuration of the slider of FIGS. 2-5.

As best seen in FIG. 5, slider 46 has a centrally disposed gap 80. Gap 80 in the preferred embodiment is 1.15 mm in width. The left and right bottom surfaces 82 and 84 are approximately 2.5 mm in width having beveled surface s86 and 88. Beveled surfaces 86 and 88 are approximately 0.8 mm and are beveled at an angle of 45° relative to the left bottom surface 82 and right bottom surface 84. Gap 80 is designed to receive rib 32 and to retain rib 32 within chamber 70.

In addition, as seen in FIG. 7, chamber 70 is also designed to receive exterior flanges 62 and 64 which are retained within chamber 70 so as to retain slider 46 on fastener strips 18 and 20. In the preferred embodiment, a force of at least three pounds and preferably 5 pounds is required to remove slider 46 from fastener strips 18 and 20.

As further seen in FIG. 7, slider 46 has a first travel and stop position 90 where the bag 10 is in the closed position and the fastener strips 18 and 10 are interlocked and a second travel and stop position 92 in which fastener strips 18 and 20 are separated from each other to allow dispensing of product from bag 10 or insertion of product therein.

As further seen in FIG. 7, the proximal and distal ends 100 and 102 are fastener strips 18 and 20 and are ultrasonically sealed to each other and to bag walls 12 and 14, proximate the lateral edges 106 and 108 of bag 10. The ultrasonic seal is to prevent the fastener strips 18 and 20 from opening, and to prevent the bag 10 from being torn when the fastener strips 18 and 20 are open.

Returning to FIG. 4, within slider 46 are inwardly facing channels 108 and 110 which are sized and positioned for slidable reception of flanges 62 and 64 and for retention of flanges 62 and 64 in slot or gap 82. On the bottom of slider 46 are a pair of inwardly facing shoulder members 111 and 112 with gap 80 therebetween. Shoulder members 111 and 112 have beveled surfaces 86 and 88 thereon for guiding fastener strips 18 and 20 into said gap 82.

Figure 13:
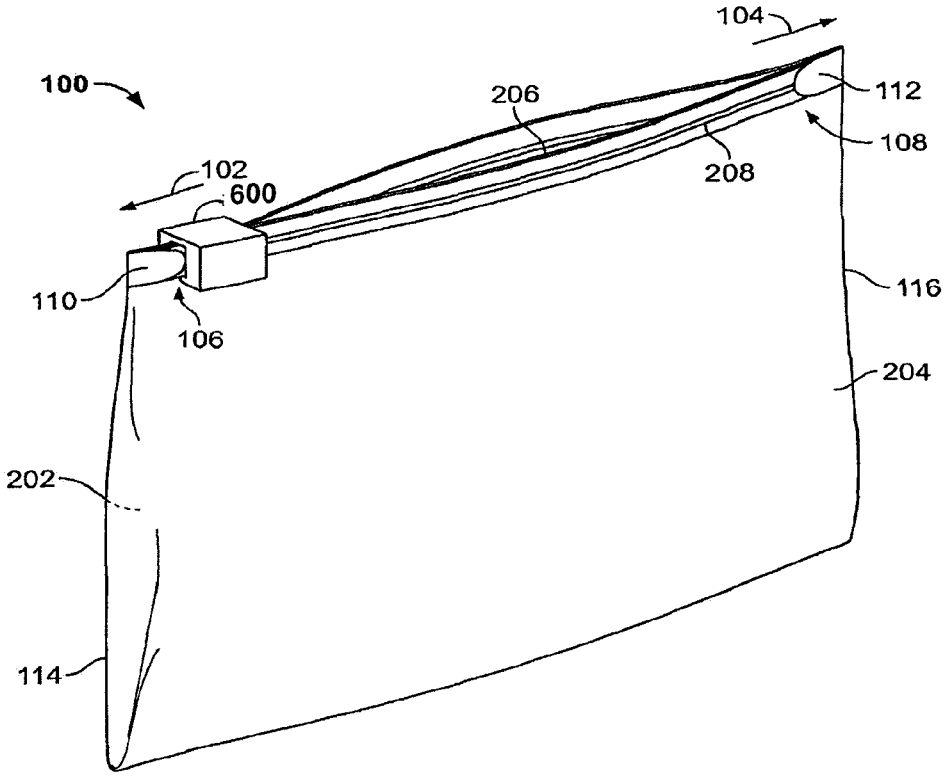
FIG. 13 is a perspective view of a reclosable container in accordance with the present invention.

Referring now to said FIG. 13, a bag or, more generally, a reclosable container 400 is illustrated. As shown, the bag 400 comprises walls 502, 504 sealed along the lateral edges 414, 416 of the walls 502, 504 to form an open-ended container. Materials commonly used in the art, such as Linear Low Density Polyethylene (LLDPE), Low Density Polyethylene (LDPE), Nylon Polypropylene (PP), or Polyethylene Terepthalate (PET), may be used to form the walls 502, 504. Complementary fastener strips 506, 508 in accordance with the present invention are mounted along upper edges of the walls 502, 504. In a presently preferred embodiment, the fastener strips 506, 508 are formed integrally with, and from the same material as, the walls 502, 504 through an extrusion process. However, the present invention is not limited in this regard and other techniques known to those having skill in the art may be employed to attach the fastener strips 506, 508 to their corresponding walls 502, 504. A slider 600 in accordance with the present invention (preferably constructed of polyethylene, polycarbonate, polystyrene, acryl nitryl butyldirene styrene or other materials commonly used in the fabrication of formed injection molded plastic pieces) is disposed on the fastener strips 506, 508. As known in the art, the slider 600 may slide in a first or opening direction 402 or, oppositely, in a second or closing direction 404 along a longitudinal length of the fastener strips 506, 508 as shown. Travel of the slider 600 along the fastener strips 506, 508 is limited at a proximal end 410 by a first stop position 406 and, at a distal end 412, by a second stop position 408. In practice, the stop positions 406, 408 are formed by fusing the fastener strips 506, 508 together using known techniques, such as ultrasonic sealing.

Figure 14:
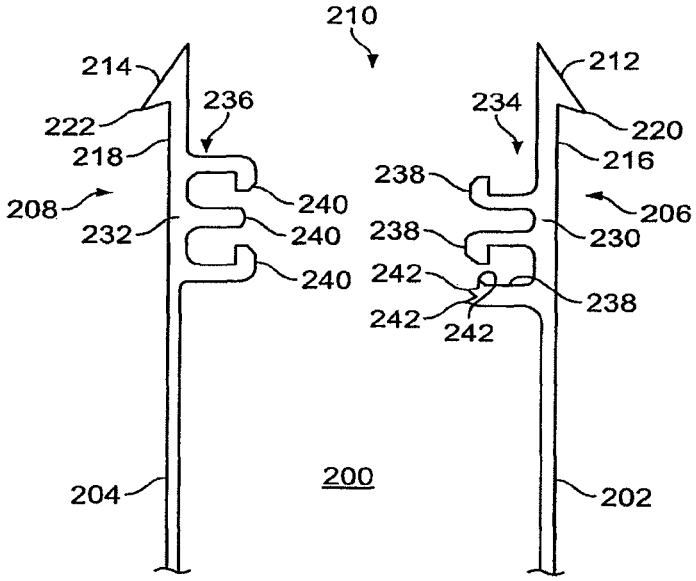
FIG. 14 is a partial, cross-sectional view of exemplary fastener strips in accordance with an embodiment of the present invention.

Referring now to FIG. 14, a partial, cross-sectional view of exemplary fastener strips 506, 508 is illustrated. Generally, the cross-sectional profiles of the various components illustrated in FIG. 14 run the entire longitudinal length of the fastener strips 506, 508. As shown, each fastener strip 506, 508 comprises a base 530, 532 and a sealing member 534, 536 formed thereon, preferably in a continuous, integral fashion. In a presently preferred embodiment, each fastener strip 506, 508 is mounted on upper edge 516, 518 of a corresponding wall 502, 504 of the bag 400. The sealing members 534, 536 each comprise a plurality of complementary sealing portions 538, 540 that, when coupled together in an engaged condition (see FIG. 7), provide a substantially leak-proof seal for the bag 400. The sealing portions 538, 540 preferably have profiles that cause the sealing members 534, 536 to interlock when fully engaged with each other. As known in the art, the interdigitation of the complementary sealing portions 538, 540 when the sealing members 506, 508 are fully engaged provides multiple sealing points that substantially run along the entire longitudinal length of the fastener strips. Although particular profiles are shown for the complementary sealing portions 538, 540 for the purposes of illustration, the present invention is not limited to the profiles shown.

As further shown in FIG. 14, each fastener strip 506, 508 preferably comprises an upward extending guide rail 512, 514. In a presently preferred embodiment, the guide rails 512, 514 serve to retain a slider on the fastener strips 506, 508. To this end, each guide rail 512, 514 preferably comprises a protrusion 520, 522. In the example illustrated in FIG. 14, each protrusion 520, 522 comprises an outward-facing flange, although other configurations, such as an inward-facing flange, a combination of inward- and outward-facing flanges or a substantially circular profile could be equally employed. Furthermore, the present invention is not limited to a particular implementation of the guide rails 512, 514, and more conventional guide rail configurations (for example, along the opposite, outward-facing sides of the bases 530, 532) may be equally employed.

In a further aspect of the present invention, one of the plurality of sealing portions 538 of a first sealing member 534 additionally comprises one or more finger members 542. Although the finger members 542 are illustrated as forming part of only one of the sealing portions 538 and of only the first sealing member 534, it is understood that additional finger members may be equally incorporated into other ones of the sealing portions 538 of the first sealing member 534, or additionally into one or more of the sealing portions 540 of the second sealing member 536. In a presently preferred embodiment, the one or more finger members 542 are incorporated into a lower-most sealing portion of the plurality of sealing portions 538. Furthermore, each finger member 542 preferably extends laterally and/or partially upwardly relative to the sealing portion in which it is formed. Further still, where more than one finger member 542 is employed, each finger member 542 preferably extends at a different angle relative to the others. As described in greater detail below, particularly with reference to FIG. 19, the finger members 542 provide a sealing engagement with a complementary portion of the sealing member 536 of the second fastener strip 508 when the fastener strips 506, 508 are maintained in a partially engaged condition, i.e., at the point along the longitudinal length of the fastener strips 506, 508 where a separation 612 of the slider 600 causes the disengagement of the fastener strips 506, 508.

Referring now to FIGS. 15-20 an exemplary slider 600 in accordance with the present invention is further illustrated. Generally, the slider 600 comprises an elongated body 602 having a top wall 604 and sidewalls 606, 608 extending downwardly from the top wall 604. Although the side walls 606, 608 may extend substantially perpendicular to the top wall 604, they may also be angled relative to the top wall 604 and, in one embodiment of the present invention (as best illustrated in FIGS. 15-19), they are preferably tilted inward approximately 2 degrees from perpendicular relative to the top wall 604. At a proximal end 601 of the slider 600, a front wall 610 is provided and, likewise, a back wall 801 is provided at a distal end 603. The front and back walls 610, 801 are preferably (but not necessarily) substantially perpendicular to the top and side walls 604-608. Collectively, the top wall 604 and sidewalls 606, 608 form an opening 614 (FIGS. 15 and 18) running along the entire length of the elongated body 602, thereby allowing passage of the fastener strips 506, 508 through the slider 600 as the slider traverses along the longitudinal length of the fastener strips 506, 508.

Figure 15:
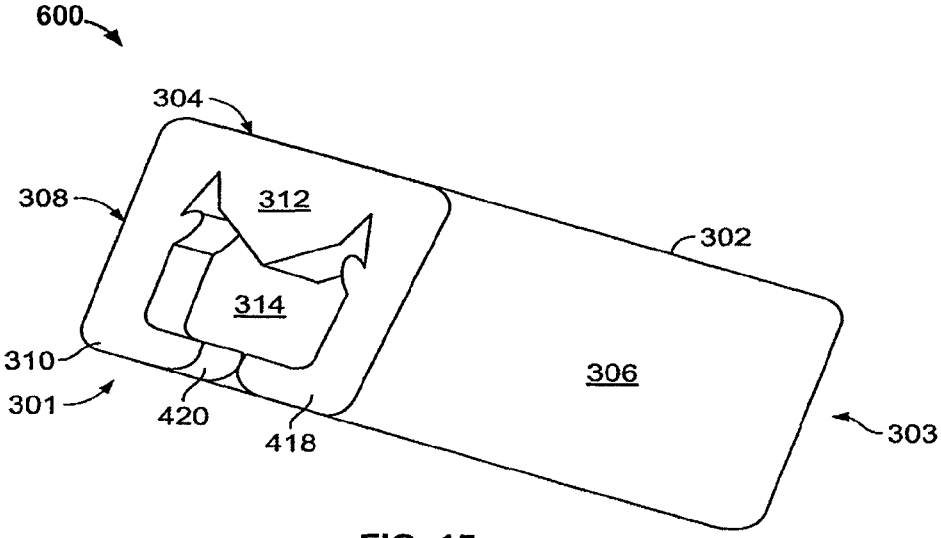
FIG. 15 is a perspective view of an exemplary slider in accordance with another embodiment of the present invention.
Figure 16:
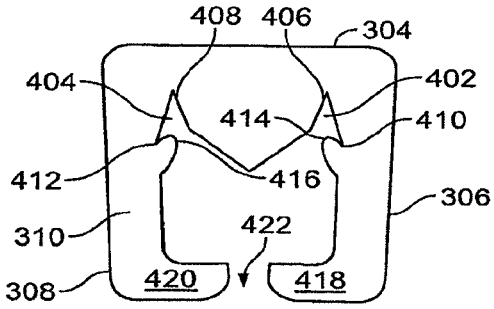
FIG. 16 is a front elevation view of the exemplary slider of FIG. 15.

As further illustrated in FIG. 15-20, the slider 600 further comprises substantially opposing, inward-facing flanges or rails 718, 720. The inward-facing flanges 718, 720 extend substantially perpendicularly relative to the sidewalls 606, 608, although this is not a requirement and other angles may be equally employed. Furthermore, the distal ends of the flanges 718, 720 define a gap 722 having dimensions such that the sealing members of the opposing fastener strips 506, 508, and particularly the sealing portion 538 having the at least one finger member 542 and its complementary sealing portion 540, are urged together to provide an additional degree of sealing, yet not completely interlocking, engagement, as best illustrated in FIG. 15. Note that where, as in the above-described preferred embodiment, the side walls 606, 608 are angled inwardly, the flanges 718, 720 may likewise be angled upwardly (relative to parallel with the top wall 604). In a presently preferred embodiment, the gap 722 is configured to be smaller than a combined width of the fastener strips 506, 508 when they are in a partially engaged condition. In another aspect of a presently preferred embodiment, the inward-facing flanges 718, 720 are preferably formed within the front wall 610. In a similar vein, an additional pair of inward-facing flanges 814, 816, defining therebetween another gap 812, are likewise disposed within the back wall 801. The additional inward-facing flanges 814, 816 are preferably affected by any angle of the side walls 606, 608 in a substantially identical manner as the first-mentioned inward-facing flanges 718, 720. Those having ordinary skill in the art will appreciate that the inward-facing flanges could run along the entire length of the elongated body 602 rather than being disposed solely within the end walls 610, 801 of the slider 600, although this is not presently preferred.

In order to retain the slider 600 on the fastener strips 506, 508, downward-facing channels 702, 704 are formed in the front wall 610. In a presently preferred embodiment, each downward-facing channel 702, 704 is defined by side portions 706, 708 of a separator 612 and by upper surfaces of grip rails 714, 716. In the same manner, the resulting of profiles 710, 712 of the downward facing channels 702, 704 substantially match the profiles of the corresponding guide rails 512, 514. The separator 612 comprises dimensions and is configured to induce separation of the sealing members 534, 536 of the corresponding fasteners strips 506, 508 without actually extending between sealing members 534, 536. As the slider 600 traverses the engaged fastener strips 506, 508, the separator block 612 causes the fastener strips 506, 508 to disengage, thereby opening the bag 400.

Figure 17:
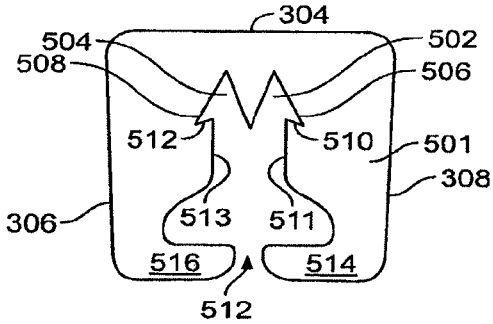
FIG. 17 is a rear elevation view of the exemplary slider of FIG. 15.
Figure 18:
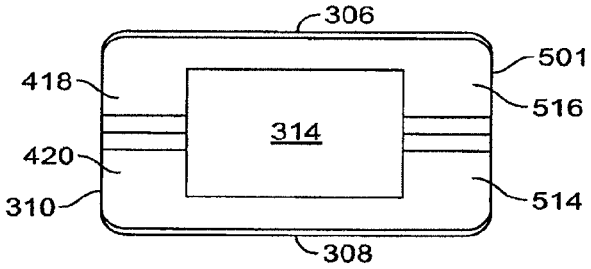
FIG. 18 is a bottom plan view of the exemplary slider of FIG. 15.

Referring to FIG. 17, the back wall 801 has formed therein additional downward-facing channels 802, 804 having profiles 806, 808 that substantially match the profiles of the guide rails 512, 514. Once again, additional grip rails 810, 812 are provided to engage the protrusions 520, 522 of the guide rails 512, 514 thereby retaining the slider 600 on the fastener strips 506, 508. In contrast to the front wall 610, the back wall 801 comprises closing gates 811, 813 configured such that the space provided between the closing gates 811, 813 forces together the sealing portions 534 of the first fastener strip 506 and the complementary sealing portions 536 of the second fastener strip 508 (see FIG. 19), thereby establishing an interlocking, engaged condition between the fastener strips 506, 508 and providing a substantially leak-proof seal.

Figure 19:
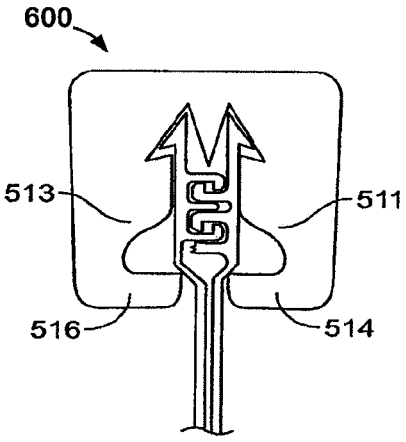
FIG. 19 is a partial, cross-section view of the exemplary fastener strips and the exemplary slider illustrating operation thereof in accordance with the present invention.
Figure 20:
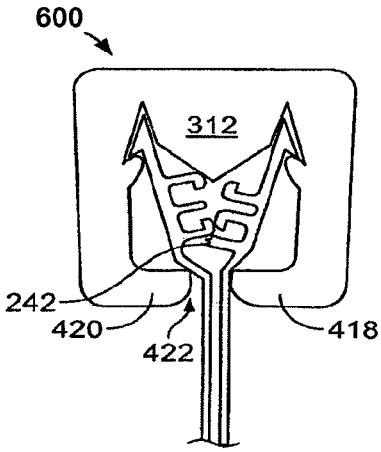
FIG. 20 is a partial, cross-section view of the exemplary fastener strips and the exemplary slider illustrating operation thereof in a partially open position.

Referring now to FIGS. 19 and 20, operation of the slider 600 in conjunction with the fastener strips 506, 508 is further illustrated. In particular, as the slider 600 is moved in the closing direction 404, the closing gates 811, 813 cause the complementary sealing portions of the sealing members 534, 536 to engage in an interlocking fashion as shown. Once again, note that the inward facing flanges 814, 816 provide substantially no aid in retaining the slider 600 on the fastener strips 506, 508. In contrast, and as illustrated in FIG. 20, as the slider 600 travels along the fastener strips 506, 508 in the opening direction 402, the separator 612 causes the plurality of complementary sealing portions 538, 540 of the sealing members 534, 536 to disengage, thereby opening the bag. Note that, at the position of the slider 600 along the fastener strips 506, 508, particularly the position of the separator 612, the sealing members 534, 536 are maintained in a partially engaged condition that, in prior art devices, would cause leaks at that location. In accordance with the present invention, however, the configuration of the inward-facing flanges 718, 720 and the resulting gap 722 defined therebetween, causes the one or more finger members 542 to engage a corresponding portion of the opposing sealing member, thereby providing additional leak resistance at the point of the slider 600 along the fastener strips 506, 508.

Figure 21:
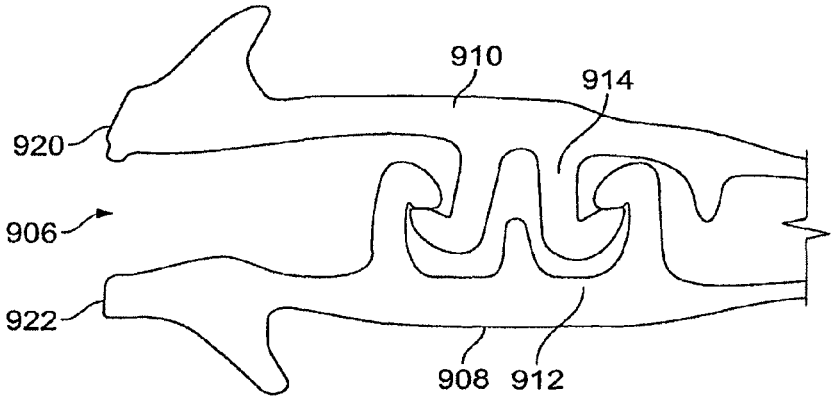
FIG. 21 is a partial, cross-section view of an alternative embodiment of the reclosable fastener profiles of FIG. 1 showing male and female profiles and guide ribs disposed on the outer walls of the profiles.

As seen in FIG. 21, the fastener strip and reclosable bag 900 are disclosed having first and second walls 902 and 904 and an open top 906 defined by first and second elongate flexible fastener strips 908 and 910 attached to the first and second walls 902 and 904, respectively. Adjacent the top of the walls one of the fastener strips 908 has a groove 912 formed therein and the other fastener strip 910 has a rib 914, previously shown in FIGS. 1-5. A portion of the rib 914 is received and retained within the groove 912 when the bag top 906 is closed. Each of the fastener strips 908 and 910 has a base 912 and 914, respectively, shown in FIG. 1 as 12 and 14. Each of the fastener strips 908 and 910 has an upper edge 920 and 922, respectively, with a slider shown in FIG. 3. The slider 600 is moveable in a first longitudinal direction 924 to progressively separate the rib 914 from the groove 908 to open the bag. The slider 600 is moveable in the opposite direction 926 to progressively return the rib 914 to a retained condition in the groove 912 to close the bag 900. As further seen in FIG. 22, a cradle 928 is provided proximate one end 930 of the fastener strip. The cradle 928 is sized, constructed and arranged to receive the base 932 of the slider 600 therein while the fastener strip 908 is sealingly engaged with the corresponding sealing portion 934 of the complementary sealing member, i.e., the rib 908. The cradle 928 preferably has a length greater than the length of the slider so as to retain the slider 600 within the cradle 928. In the embodiment shown, the cradle 928 has a tab 936 extending at an angle of approximately 45° therefrom for abutment against and retention of the slider 600 within the cradle 928.

In a preferred embodiment the cradle is substantially C-shaped so as to retain the slider therein. By C-shaped it is meant that it has a recessed interior and at least one tab extending therefrom at an angle of 15-30° so as to abut against the slider and retain the slider within the cradle. On the opposite side from the tab 936 is a curved lip 938 for abutting against the slider 600 therein. As further seen in FIG. 22, the end portion of the fastener strips has a spot seal section 940 in which the fastener strips are ultrasonically or heat-sealed together so that the ends of the bag and the ends of the fastener strips will not leak.

Figure 22:
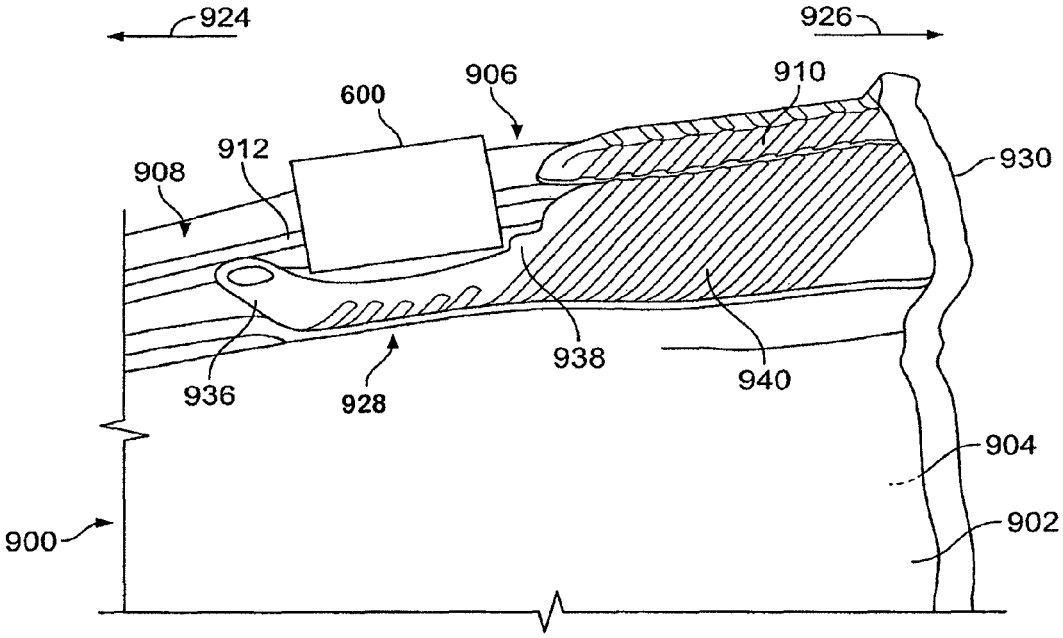
FIG. 22 is a vertical section of an alternative embodiment of the container 13 showing in particular a cradle proximate the first end of the fastener strip which is sized, constructed and arranged to receive and retain the base of a slider when the slider is positioned at the first end of the fastener strip.

As further seen in FIG. 22 of the drawings, in a preferred embodiment cradle 928 has a length of 9.78 mm and a depth of 3.35 mm. The base of the cradle is approximately 2.03 mm. All of these dimensions are, of course, subject to variation in manufacture of up to 0.25 mm.

In the embodiment shown, the cradle tip has a radius of 0.07 so as to allow easier passage of the slider 600 thereover.

Figure 23:
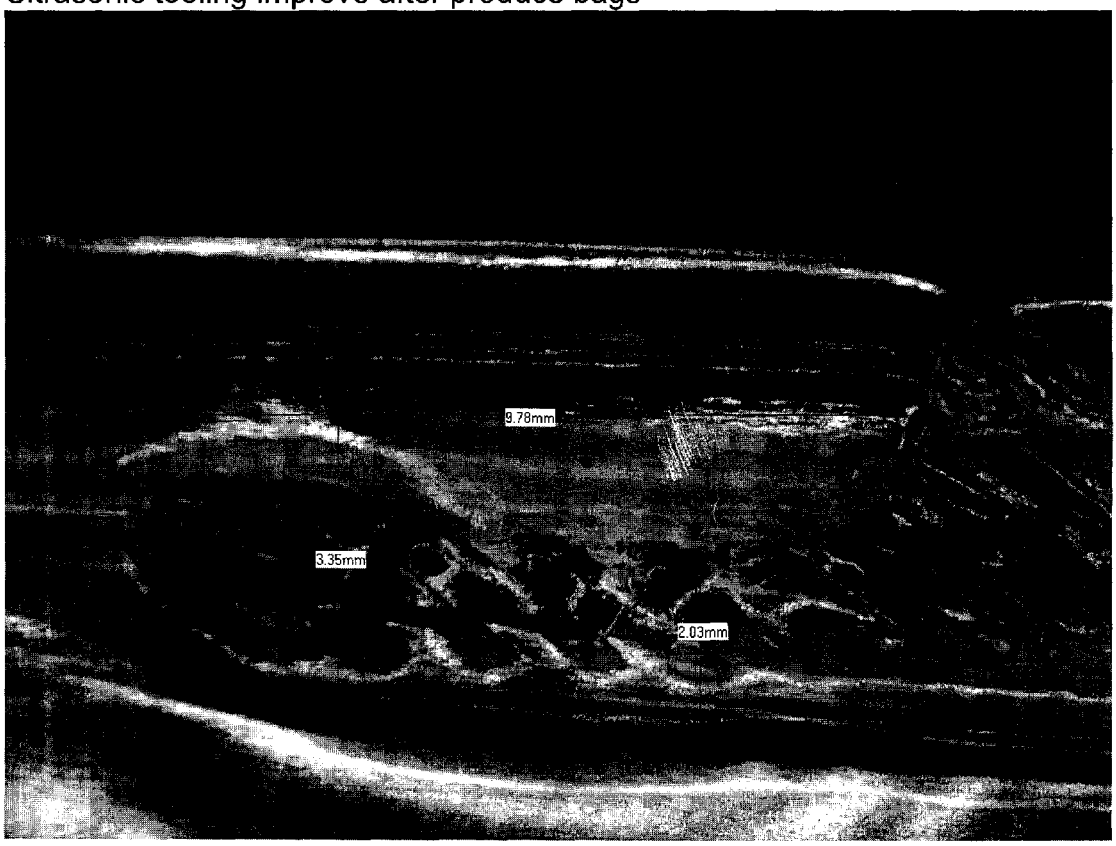
FIG. 23 of the drawings is a black and white photograph showing the cradle of the present invention on a reclosable fastener affixed to a reclosable bag.

In order to more clearly illustrate the invention, further attached is a photograph of the cradle of the present invention and die drawings showing the preferred dimensions. The photograph and die drawings may be referred to as FIGS. 23, 24, and 25.

While the invention has been described with respect to certain preferred embodiments, it will be understood by those of skill in the art that there are modifications, substitutions and other changes that can be made, yet will still fall within the intended scope of the invention.

Figure 25:
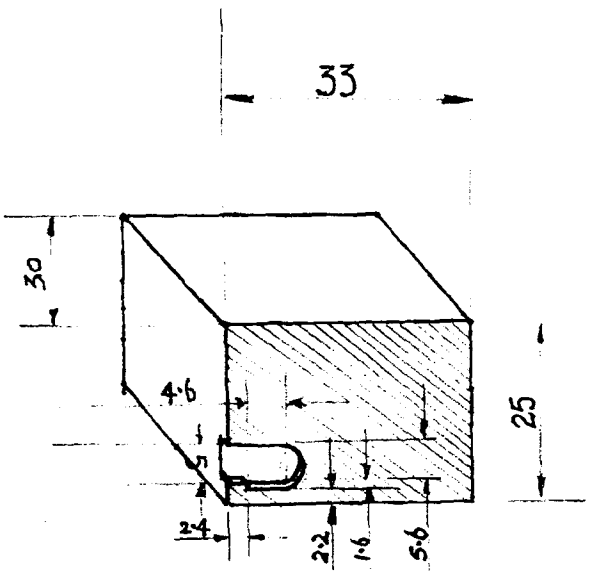
FIG. 25 the other half of the ultrasonic horn of FIG. 24.
Figure 24:
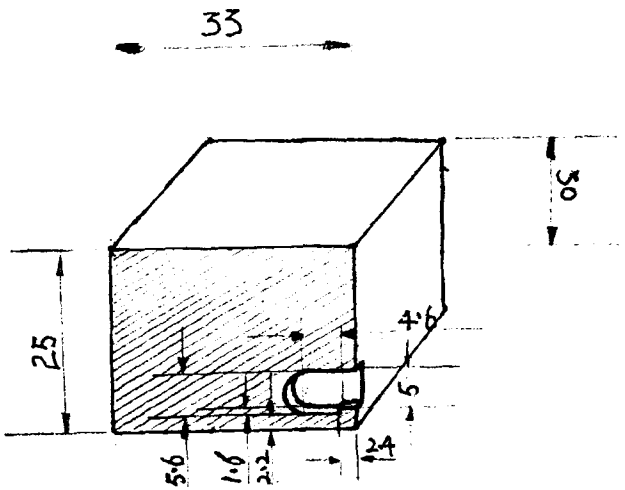
FIG. 24 is a front perspective view of the ultrasonic horn used to compress the fastener profile at a first end so as to create the cradle shown in FIGS. 21, 22, and 23.

As seen in FIG. 24, a half of an ultrasonic horn 1000 is shown having a cut-out portion 1002 shaped in the form of the cradle 928. Similarly, a second half 1006, as shown in FIG. 25, of the ultrasonic horn is provided having a cut-out 1008, also in the form of a cradle. When compressed against the fastener strip approximate one end 930, it creates the cradle and the sealed portion 934 which retains the fastener strip in a leak-proof configuration.

We claim:

1. In a reclosable bag having first and second walls and an open top defined by first and second elongate flexible fastener strips attached to the first and second walls, respectively, adjacent the top of the walls, one of the fastener strips having a profile portion forming a groove and the other fastener strip having a profile portion forming a rib with a portion of the rib received and retained in the groove when the bag top is closed, each of the fastener strips having a base connected to the respective wall, and each of the strips having an upper edge adjacent the upper edge of the other strip, and the bag having a slider mounted on the fastener strips and movable in one direction longitudinally of the fastener strips to progressively separate the rib from the groove to open the bag, and the slider being movable in the opposite direction to progressively return the rib portion to a retained condition in the groove to close the bag, the reclosable bag comprising:

a cradle proximate one end of said fastener strip said cradle having a single recessed portion and being sized, constructed and arranged to receive and retain the base of said slider therein while said fastener strip is sealingly engaged with said corresponding sealing portion of said complementary sealing member, said recessed portion having a length greater than the length of said slider so as to retain the slider within said cradle and a tab that shuts against said slider when said slider is within said cradle.

2. The bag of claim 1, wherein said cradle has a length greater than the length of said slider so as to retain said slider within said cradle.

3. The bag of claim 1, wherein said cradle has said tab extending therefrom at an angle of approximately 45° for abutment against and retention of said slider in said cradle.

4. The bag of claim 1 wherein said slider further comprises:

a separator situated on the slider and having a proximal portion attached to the top of the slider and extending downwardly therefrom and having a distal portion residing in a first space between the top of the slider and the upper edges of the fastener strip when the rib portion is retained in the groove of the groove-forming profile; said separator having an arrow-shaped tip having an angle of 60°±30° constructed and arranged to facilitate selective separation of said rib from said groove;

said rib remaining retained within said groove when said slider is within said cradle so as to provide a seal of said fastener strip.

5. The bag of claim 4, wherein the separator has a length of 2.3 mm±0.3 mm.

6. The bag of claim 4, wherein the separator is integral with the slider and is made of one integral homogenous unit of plastic.

7. The bag of claim 4, wherein said cradle comprises said tab and said tab abuts against said separator when said slider is within said cradle.

8. The bag of claim 1, wherein each of the outside walls has a flange turned outwardly from the wall and running parallel to the said upper edges thereof, said flange being constructed and arranged to retain said slider thereon.

9. The bag of claim 1, wherein the slider has first and second travel-end stop positions on the strips, the first stop position being the bag-closed stop position, and the second being the bag-opened stop position.

10. The reclosable bag of claim 1 wherein the proximal and distal ends of each of said fastener strips are ultrasonically sealed to each other and to said bag walls proximate the lateral edge of said bag.

11. The bag of claim 1, wherein said cradle is substantially C-shaped in its internal configuration so as to retain said slider therein.

12. The bag of claim 11, wherein said tab extends at an angle of 15-30° from said cradle so as to abut against said slider and retain said slider within said cradle.

13. The bag of claim 1, wherein said cradle is curved on at least one end so as to retain said slider within said cradle.

14. The bag of claim 1, wherein said cradle is curved on both ends so as to retain said slider within said cradle.

15. A bag closure assembly comprising:

first and second elongate flexible strips securable to marginal portions of a bag opening, one of the strips having a profile portion forming a groove and the other strip having a profile portion forming a rib with a portion received and retained in the groove to hold the strips together, each of the strips having an upper edge adjacent the upper edge of the other strip;

a slider mounted on the strips and movable in one direction longitudinally of the strips to progressively separate the rib from the groove to separate the strips, and the slider being movable in the opposite direction to progressively return the rib portion to retained condition in the groove to join the strips;

a separator situated in the slider and having a proximal portion attached to the slider and having a distal portion residing in the groove; and a cradle proximate one end of said fastener strip, said cradle having a recessed portion and being sized, constructed and arranged to retain the base of said slider therein while said fastener strip is sealingly engaged with said corresponding sealing portion of said complementary sealing member, said recessed portion having a length greater than the length of said slider so as to retain the slider within said cradle and a tab that shuts against said slider when said slider is within said cradle, thereby retaining said rib and said groove in a sealed interlocked position.

16. The bag closure assembly of claim 15, wherein the slider is integral with the separator and is made of one integral homogenous unit of plastic.

17. The bag closure assembly of claim 15, wherein each of the strips has an upper outside wall parallel to the upper outside wall of the other strip, and a pair of flanges turned outwardly from the wall disposed parallel to said upper outside wall, said flanges being sized, constructed and arranged for retention within the slider.

18. The bag closure assembly of claim 17 wherein said slider has a pair of inwardly facing channels so as to form a slot for slidable reception of said flanges and for retention of said flanges within said slot.

19. The bag closure of claim 18 wherein each said channel includes oppositely disposed inwardly facing shoulder members having a gap therebetween, said shoulder members being disposed on the bottom of said slides.

20. The bag closure of claim 19 wherein said shoulder members each have a beveled surface positioned to guide said fastener into said gap.

21. The bag closure assembly of claim 15, wherein the separator has a point at its distal end for entering between the touching edges of the strips and pivoting downward to separate the rib from the groove when the slider is moved in the one direction, thereby wedging the strips apart.

22. The bag closure assembly of claim 21, wherein the point is formed by sides of the separator; and the slider has interior walls that converge to squeeze the strips together when the slider is moved in said opposite direction; and the point and the walls converge in the said one direction.

23. The fastener of claim 15, wherein said tab extends at an angle of 15-30° from said cradle so as to abut against said slider and retain said slider within said cradle.

24. The bag of claim 15, wherein said cradle comprises a tab and said tab abuts against said separator when said slider is within said cradle.

25. The bag of claim 15, wherein said cradle is curved on at least one end so as to retain said slider within said cradle.

26. The bag of claim 15, wherein said cradle is curved on both ends so as to retain said slider within said cradle.

27. In a reclosable bag having first and second walls and an open top defined by first and second elongate flexible fastener strips attached to the first and second walls, respectively, adjacent the top of the walls, one of the fastener strips having a profile portion forming a groove and the other fastener strip having a profile portion forming a rib with a portion of the rib received and retained in the groove when the bag top is closed, each of the fastener strips having a base connected to the respective wall, and each of the strips having an upper edge adjacent the upper edge of the other strip, and the bag having a slider mounted on the fastener strips and movable in one direction longitudinally of the fastener strips to progressively separate the rib from the groove to open the bag, and the slider being movable in the opposite direction to progressively return the rib portion to a retained condition in the groove to close the bag, the reclosable bag comprising:

each of the outside walls has a flange extending outwardly from the wall and running parallel to the said upper edges thereof, said flange being constructed and arranged to retain said slider thereon; and a cradle proximate to one end of said fastener strip said cradle having a recessed portion and being sized, constructed and arranged to receive and retain the base of said slider therein while said fastener strip is sealingly engaged with said corresponding sealing portion of said complementary sealing member, said recessed portion having a length greater than the length of said slider so as to retain the slider within said cradle and a tab that shuts against said slider when said slider is within said cradle.

28. The bag of claim 27, wherein the slider has first and second travel-end stop positions on the strips, the first stop position being the bag-closed stop position, and the second being the bag-opened stop position.

29. The bag of claim 27, wherein said flanges are substantially rectangular in shape.

30. The bag of claim 27, wherein each of said walls of said bag has a single one of said flanges extending from said wall.

31. A bag closure assembly comprising:

first and second elongate flexible strips securable to marginal portions of a bag opening, one of the strips having a profile portion forming a groove and the other strip having a profile portion forming a rib with a portion received and retained in the groove to hold the strips together, each of the strips having an upper edge adjacent the upper edge of the other strip;

a slider mounted on the strips and movable in one direction longitudinally of the strips to progressively separate the rib from the groove to separate the strips, and the slider being movable in the opposite direction to progressively return the rib portion to retained condition in the groove to join the strips;

each of the strips has an upper outside wall parallel to the upper outside wall of the other strip, and a pair of flanges turned outwardly from the wall disposed parallel to said upper outside wall, said flanges being sized, constructed and arranged for retention within the slider;

a cradle proximate one end of said fastener strip said cradle having a recessed portion and being sized, constructed and arranged to receive and retain the base of said slider therein while said fastener strip is sealingly engaged with said corresponding sealing portion of said complementary sealing member, said recessed portion having a length greater than the length of said slider so as to retain the slider within said cradle and a tab that shuts against said slider when said slider is within said cradle.

32. The bag closure assembly of claim 31, wherein the proximal and distal ends of each of said fastener strips are ultrasonically sealed to each other and to said bag walls proximate the lateral edge of said bag.

33. The bag closure assembly of claim 31, wherein said slider has a pair of inwardly facing channels so as to form a slot for slidable reception of said flanges and for retention of said flanges within said slot.

34. The bag closure assembly of claim 33, wherein said channels have oppositely disposed inwardly facing shoulder members having a gap therebetween, said shoulder members being disposed on the bottom of said channels.

35. The bag closure assembly of claim 34, wherein said shoulder members each have a beveled surface positioned to guide said fastener into said gap.

36. The bag closure assembly of claim 31, wherein said flanges are substantially rectangular in shape.

37. The bag closure assembly of claim 31, wherein each of said walls of said bag has a single one of said flanges extending from said wall.

38. The bag closure assembly of claim 31, wherein said tab extends at an angle of 15-30° from said cradle so as to abut against said slider and retain said slider within said cradle.

39. The bag closure assembly of claim 31, wherein said cradle comprises a tab and said tab abuts against said separator when said slider is within said cradle.

40. The bag closure assembly of claim 31, wherein said cradle is curved on at least one end so as to retain said slider within said cradle.

41. The bag closure assembly of claim 31, wherein said cradle is curved on both ends so as to retain said slider within said cradle.

42. The bag closure assembly of claim 31, wherein said cradle is slightly larger than the slides so as to allow variations in the size of the slider provided while still retaining said slider within said cradle.

43. An elongate flexible fastener strip for use with a reclosable bag, the fastener strip comprising:

a base;

a sealing member, attached to the base, including a plurality of sealing portions configured to engage complementary sealing portions forming part of a complementary sealing member of a complementary fastener strip; and at least one finger member extending from a first sealing portion of the plurality of sealing portions, the at least one finger member configured to sealingly engage a first complementary portion of the complementary sealing member;

a slider for selectively engaging and disengaging said sealing portion; and a cradle proximate one end of said fastener strip said platform being sized, constructed and arranged to receive and retain the base of said slider therein while said fastener strip is sealingly engaged with said corresponding sealing portion of said complementary sealing member, said recessed portion having a length greater than the length of said slider so as to retain the slider within said cradle and a tab that shuts against said slider when said slider is within said cradle.

44. The fastener strip of claim 43, wherein said cradle has a length greater than the length of said slider so as to retain slider within said cradle.

45. The fastener strip of claim 43, wherein said cradle has a tab extending therefrom at an angle of approximately 45° for abutment against retention of said slider in said cradle.

46. The fastener strip of claim 43, wherein said plurality of sealing portions comprises at least one post.

47. The fastener strip of claim 43, wherein the first portion of the sealing member is a lowermost portion of the sealing member.

48. The fastener strip of claim 43, wherein the at least one finger member extends laterally and partially upwardly from the first portion of the sealing member.

49. The fastener strip of claim 43, wherein each finger member of said plurality of finger members extends from the first portion at a different angle relative to other finger members of said plurality of finger members.

50. The fastener strip of claim 43, wherein the at least one finger member sealingly engages the first complementary portion in a region of the fastener strip where a slider, when retained on the fastener strip, resides.

51. The fastener strip of claim 43, further comprising:

an elongate guide rail disposed on an upper edge of the fastener strip, the guide rail including at least one protrusion configured to retain a slider on the fastener strip.

52. The elongate fastener strip of claim 43, wherein said cradle comprises a recessed portion therein and at least one tab extending therefrom for selective retention of said slider within said cradle.

53. The elongate fastener strip of claim 43, wherein said tab extends at an angle of 15-30° from said cradle so as to abut against said slider and retain said slider within said cradle.

54. The elongate fastener strip of claim 43, wherein said cradle comprises a tab and said tab abuts against said separator when said slider is within said cradle.

55. The elongate fastener strip of claim 43, wherein said cradle is curved on at least one end so as to retain said slider within said cradle.

56. The elongate fastener strip of claim 43, wherein said cradle is curved on both ends so as to retain said slider within said cradle.

57. A reclosable bag comprising:

first and second flexible walls; and complementary fastener strips attached to and adjacent an opening formed by the first and second walls, respectively, each of the complementary fastener strips comprising a base and a sealing member attached to the base, each sealing member comprising a plurality of sealing portions configured to engage complementary sealing portions forming part of the sealing member of the complementary fastener strip; and for a first fastener strip of the complementary fastener strips, at least one finger member extending from a first sealing portion of the plurality of sealing portions, the at least one finger member configured to sealingly engage a first complementary portion of the sealing member of the complementary fastener strip;

a slider having:

an elongate body having a top wall and side walls extending downward from, and substantially perpendicular to, the top wall;

inwardly facing flanges at lower ends of the side walls, the inwardly facing flanges defining a gap therebetween configured to urge the first portion of the first sealing member and the first complementary portion of the sealing member of the complementary fastener strip together such that the at least one finger sealingly engages the first complementary portion; and at least one of said fastener strips further having a cradle proximate one end of said fastener strip said platform being sized, constructed and arranged to receive and retain the base of said slider therein while said fastener strip is sealingly engaged with said corresponding sealing portion of said complementary sealing member, said recessed portion having a length greater than the length of said slider so as to retain the slider within said cradle and a tab that shuts against said slider when said slider is within said cradle.

58. The reclosable bag of claim 57, wherein the plurality of sealing portions comprises at least one post.

59. The reclosable bag of claim 57, wherein the first portion of the sealing member is a lowermost portion of the sealing member.

60. The reclosable bag of claim 57, wherein the at least one finger member extends laterally and partially upwardly from the first portion of the sealing member.

61. The reclosable bag of claim 57, wherein each finger member of a plurality of finger members extends from the first portion at a different angle relative to other finger members of the plurality of finger members.

62. The reclosable bag of claim 57, wherein the at least one finger member sealingly engages the first complementary portion in a region of the fastener strip where a slider, when retained on the fastener strip, resides.

63. The reclosable bag of claim 57, wherein the inwardly facing flanges are substantially perpendicular to the side walls.

64. The reclosable bag of claim 57, wherein the side walls are configured to extend downwardly past the fastener strips.

65. The reclosable bag of claim 57, wherein the gap defined by the inwardly facing flanges is smaller than a combined width of the complementary fastener strips when they are in a partially engaged condition, thereby urging the at least one finger member to sealingly engage the first complementary portion.

66. The reclosable bag of claim 57, wherein the plurality of sealing portions comprises at least one post.

67. The reclosable bag of claim 57, wherein the first portion of the sealing member is a lowermost portion of the sealing member.

68. The reclosable bag of claim 57, wherein the means for sealingly engaging the first complementary portion in a region of the fastener strip comprises a slider retained on the fastener strip.

* * * * *